US006620053B2

(12) United States Patent
Tseng

(10) Patent No.: US 6,620,053 B2
(45) Date of Patent: Sep. 16, 2003

(54) GOLF CLUB

(76) Inventor: Wen-Cheng Tseng, No. 27, Kung Chuan Rd., Tai-Shan Hsiang, Taipei Hsien (TW)

( * ) Notice: Subject to any disclaimer, the term of this patent is extended or adjusted under 35 U.S.C. 154(b) by 0 days.

(21) Appl. No.: 10/037,230

(22) Filed: Jan. 2, 2002

(65) Prior Publication Data

US 2002/0151375 A1 Oct. 17, 2002

(30) Foreign Application Priority Data

Apr. 12, 2001 (TW) ..... 90205700 U

(51) Int. Cl.[7] ..... A63B 53/02

(52) U.S. Cl. ..... 473/297; 473/306; 473/307; 473/312

(58) Field of Search ..... 473/288, 298, 473/299, 305, 306, 307, 311, 312, 245, 246, 247, 248, 297, 318

(56) References Cited

U.S. PATENT DOCUMENTS

| | | | | | |
|---|---|---|---|---|---|
| 1,643,754 | A | * | 9/1927 | Sleith | 473/306 |
| 2,332,342 | A | * | 10/1943 | Reach | 473/248 |
| 5,137,275 | A | * | 8/1992 | Nelson | 473/306 |
| 5,569,097 | A | * | 10/1996 | Veux et al. | 473/292 |
| 5,632,691 | A | * | 5/1997 | Hannon et al. | 473/292 |
| 5,653,645 | A | * | 8/1997 | Baumann | 473/305 |

* cited by examiner

*Primary Examiner*—Stephen Blau
(74) *Attorney, Agent, or Firm*—Dellet and Walters

(57) ABSTRACT

A golf club with high accuracy in driving a golf ball is disclosed. The golf club includes a tapered hollow shaft having a thin end and a thick end, with a weight received in the hollow shaft. A head is formed with a neck that defines a stepped hole for fixedly receiving the thin end of the shaft. Importantly, the head is made less heavy than a related standard by an amount equivalent to the weight in the hollow shaft, and so the golf club has the same gross weight as a normal club.

4 Claims, 4 Drawing Sheets

GOLF CLUB

BACKGROUND OF THE INVENTION

1. Field of the Invention

The present invention relates to a golf club and, more particularly, to a golf club with high accuracy in driving a golf ball.

2. Description of Related Art

As illustrated in FIG. 4, a golf club consists of a shaft (80) with a grip (81) at one end and an offset head (82) at the other. It is at the grip (81) that a golfer holds the club, swinging it in the air until hitting a ball at a striking face (84) on the head (82). The ball is driven in a direction depending on how the face (84) is orientated when it hits the ball. In general, a correct orientation of the face (84) is always important to the accuracy of the final driving during the full period when the club is swung in the air.

On the other hand, the head (82) has a certain heaviness, such as 200 grams, which brings about an inertial force as the club is being swung more and more quickly in the air. The inertial force resulted from the offset head (82) becomes an inertial moment about the shaft (10), resulting in a tendency to swivel the club on the axle of the shaft (80) and hence to vary the orientation of the striking face (84) of the head (82).

Therefore, it is an objective of the invention to provide agolf club to mitigate and/or obviate the aforementioned problem.

SUMMARY OF THE INVENTION

The object of the present invention is to provide a golf club with high accuracy in driving a golf ball.

Other objects, advantages and novel features of the invention will become more apparent from the following detailed description when taken in conjunction with the accompanying drawings.

DETAILED DESCRIPTION OF THE PREFERRED EMBODIMENT

Figure 1:
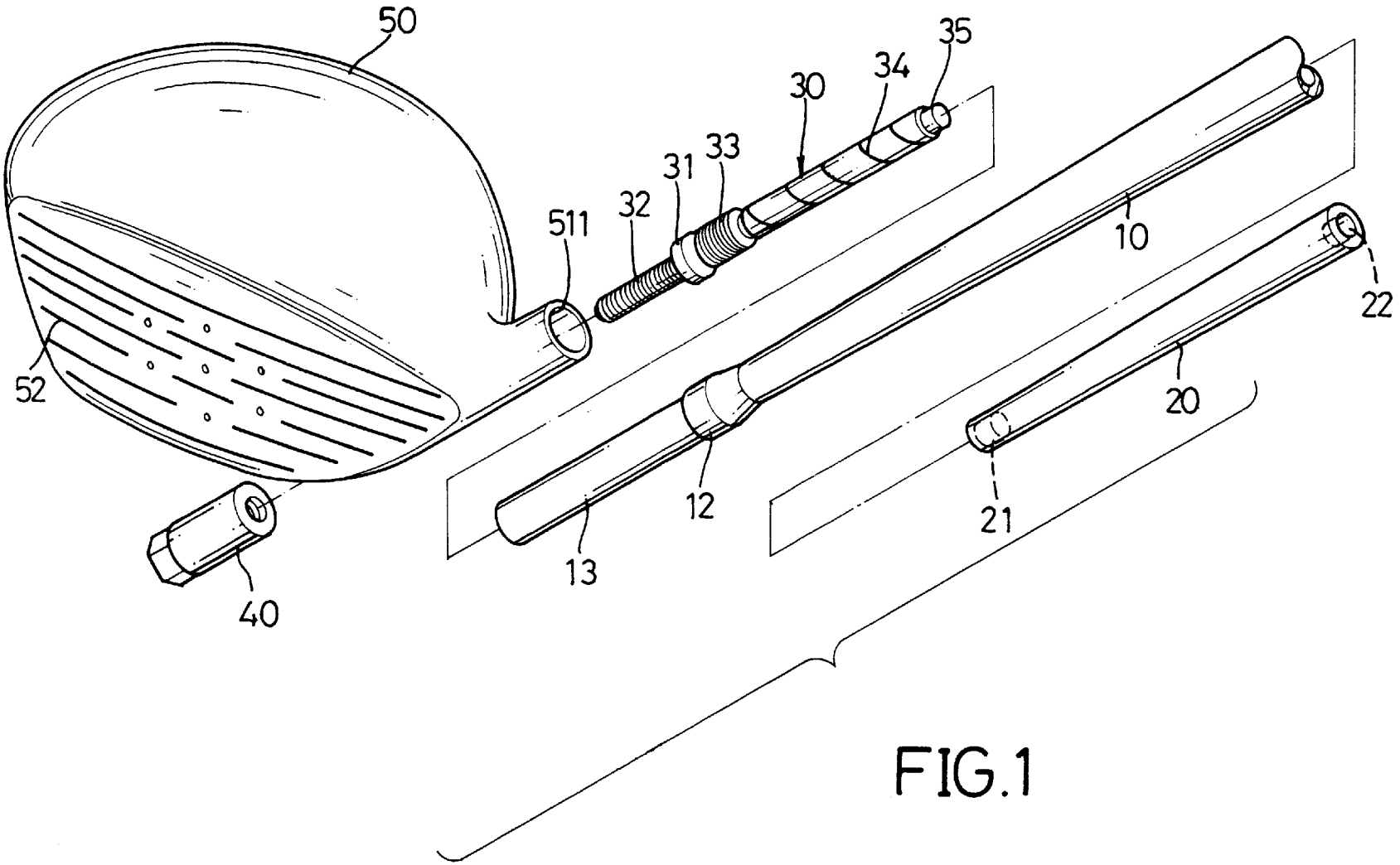
FIG. 1 is a fragmentary exploded perspective view of a preferred embodiment of a golf club in accordance with the present invention.

Referring to FIG. 1, a golf club in accordance with the present invention includes a tapered hollow shaft (10) having a thin end (13) and a thick end (not shown), with a flange (12) formed around the shaft (10) near the thin end (13). A head (50), which has a striking face (52), is configured to be attached to the thin end (13) of the shaft (10).

The shaft (10) is provided with a hosel (30) at its thin end (13). The hosel (30) has a threaded outer section (32), a threaded intermediate section (33) and an annular stop (31) formed between the threaded sections (32, 33). In the illustrated embodiment, the hosel (30) has a helical slot (34) defined therearound and a boss (35) formed at an end thereof opposed to the threaded outer section (32).

Figure 2:
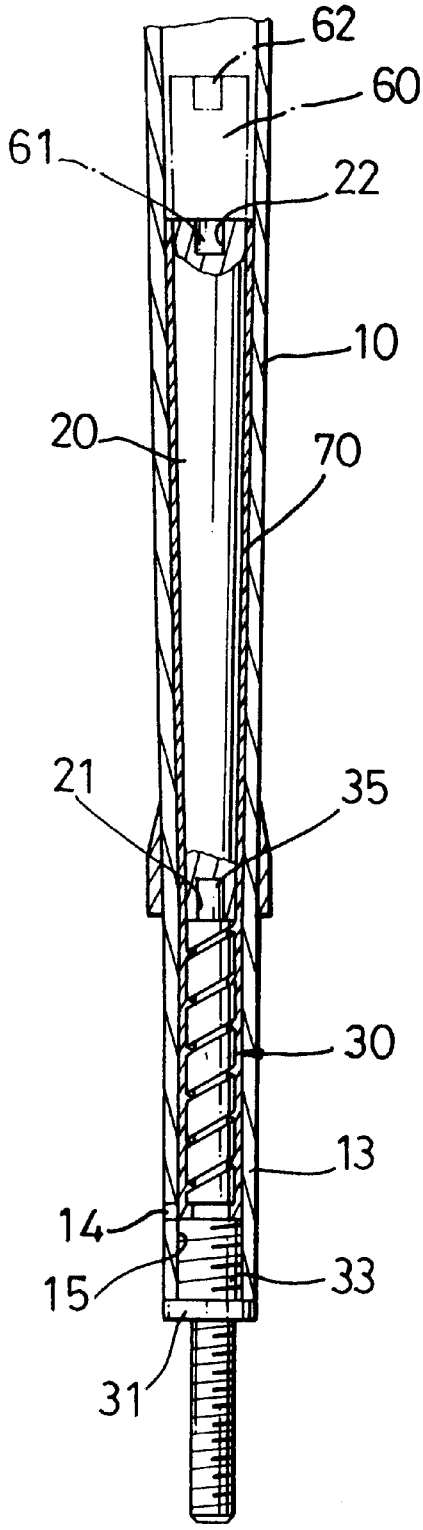
FIG. 2 is a fragmentary cross-sectional view of parts of the golf club shown in FIG. 1.

Referring to FIG. 2, the hollow shaft (10) has a tapered inner channel (not numbered) for receiving a bar-like weight (20). The weight (20), shaped to mate with the inner channel, preferably has two opposed recesses (21, 22) defined in ends thereof, as best shown in FIG. 1.

The hollow shaft (10) further has a threaded inner periphery (15) defined at its thin end (13), and the threaded intermediate section (33) of the hosel (30) is engaged with the threaded inner periphery (15) in such a way that its annular stop (31) abuts the thin end (13) of the shaft (10) and its boss (35) fits in the recess (21) of the weight (20). As a result, the hosel (30) is connected to the shaft (10).

A secondary weight (60) may be additionally received in the channel of the hollow shaft (10), if necessary. The secondary weight (60) is located adjacent to an end of the weight (20) opposed to the hosel (30), and has a boss (61) configured to fit in the recess (22) of the weight (20). The secondary weight (60) may further have a recess (62) for a third weight.

The hosel (30) and the weight (20) or weights (20, 60) are preferably joined to the shaft (10) by gel (70), which may also be applied to the recesses (21, 22) and the bosses (35, 61). In this case, the hollow shaft (10) has a vent (14) defined therein, in order to let air into the hollow shaft (10) to help consolidation of the gel (70), as well as to lead surplus gel (70) out of the hollow shaft (10).

Figure 3:
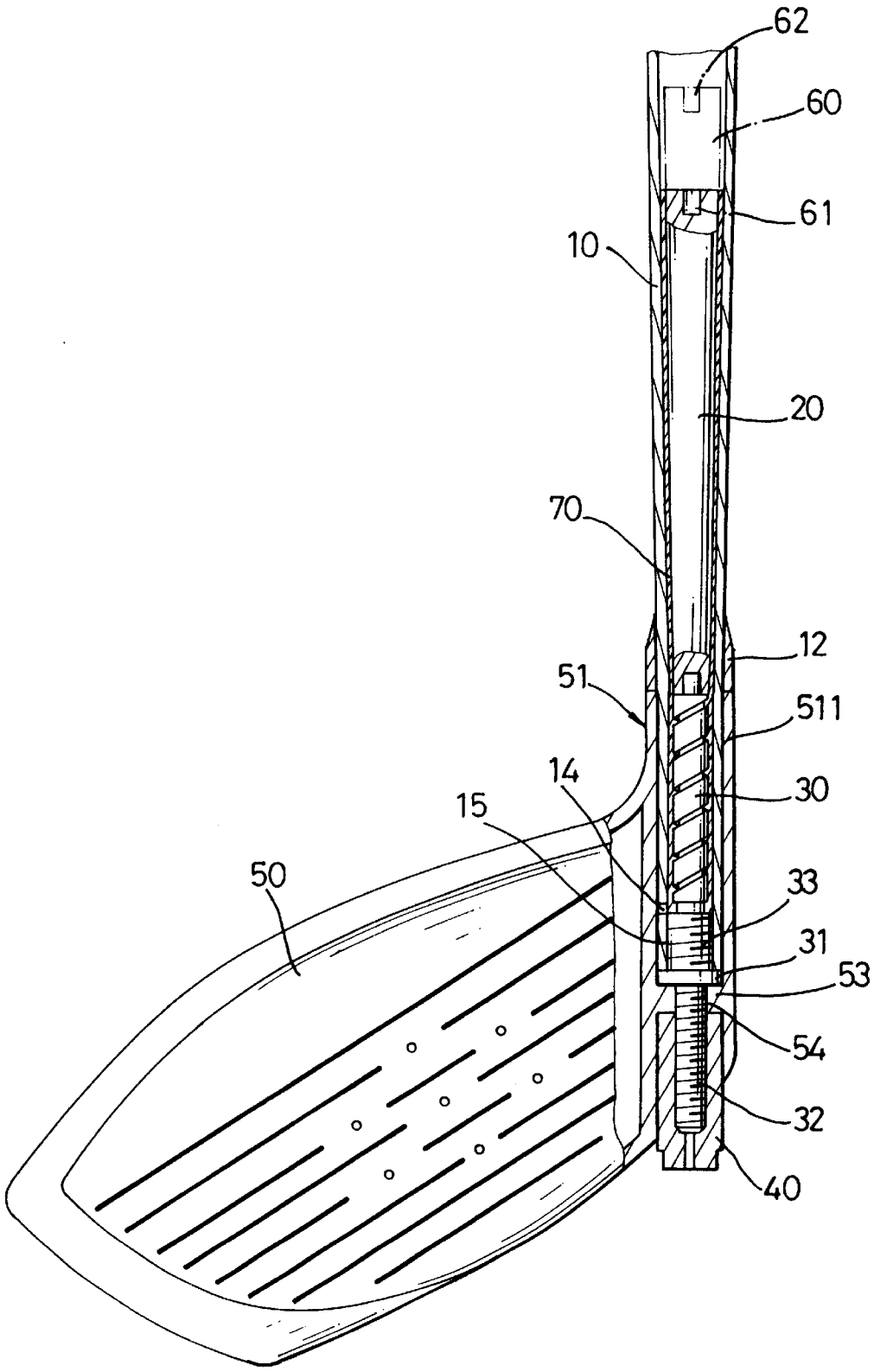
FIG. 3 is a fragmentary cross-sectional view of the golf club shown in FIG. 1.
Figure 4:
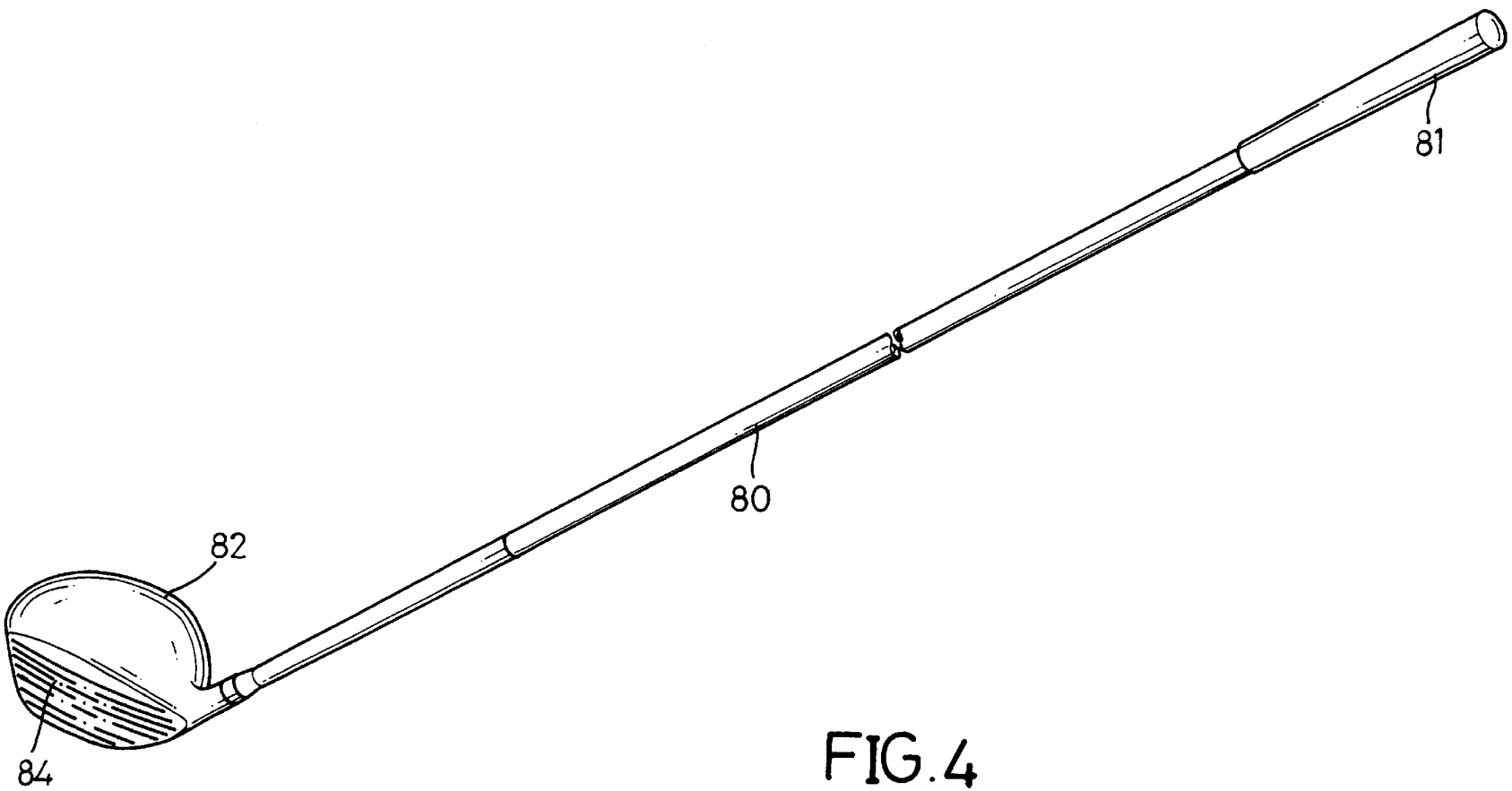
FIG. 4 PRIOR ART
FIG. 4 is a schematic view of a golf club.

Referring to FIG. 3, the head (50) has a neck (51) formed with a stepped hole (511) for receiving both the thin end (13) of the shaft (10) and the threaded sections (32, 33) of the hosel (30).

Formed in the stepped hole (511) is an inner collar (53) that defines a through-hole (54). The threaded outer section (32) of the hosel (30) extends through the through-hole (54) of the inner collar (53), and is threaded engaged with a nut (40) in such a manner that either the flange (12) of the shaft (10) abuts the rim of the neck (51) or the annular stop (31) of the hosel (32) abuts the inner collar (53), thus attaching the head (50) to the shaft (10).

In the inventive golf club, it is important that the head (50) is made less heavy than a related standard by an amount equivalent to the weight (20) in the hollow shaft (10), or alternatively, to the weights (20, 60) if the secondary one (60) is provided.

In other words, the golf club has been rearranged in its mass distribution by removing a certain amount of its total mass from the head (50) into the shaft (10), and so this golf club has the same gross weight as a normal one.

From the above description, it can be appreciated that the invention has an advantage of high accuracy in driving a golf ball, due to the fact that the less heavy head (50) brings about a reduced inertial moment about the shaft (10) while the club is being swung towards a golf ball. Furthermore, the unchanged gross weight may give any user an usual feeling whenever he/she is swinging the golf club.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A golf club with high accuracy in driving a golf ball, comprising:

a tapered hollow shaft (10) having a thin end (13) and a thick end, said hollow shaft (10) being formed with an insert (30) at said thin end of said shaft (10), a primary weight (20) received in said hollow shaft (10), said primary weight (20) having two oppose recesses (21, 22) defined in ends thereof, and a secondary weight (60) received therein in a location adjacent to a end of said primary weight (20) opposed to said insert (30), said insert (30) and said secondary weight (60) each having a boss (35, 62) configured to fit in corresponding one of said recesses of said primary weight (20);

a head (50) having a neck (51) formed thereon, said neck (51) defining a stepped hole (511) for fixedly receiving said thin end (13) of said shaft (10).

2. The golf club as claimed in claim 1, wherein said shaft (10) has a threaded inner periphery (15) defined at said thin end (13) thereof, and wherein said insert (30) has a threaded outer section (32), a threaded intermediate section (33) and an annular stop (31) formed between said threaded sections (32, 33), with said threaded intermediate section (33) adapted to be threadedly engaged with said inner periphery (15) of said shaft (10) and with said annular stop (31) adapted to abut said thin end (13) of said shaft (10).

3. The golf club as claimed in claim 2, wherein an inner collar (53) is formed in said stepped hole (511) of said head (50), and wherein said threaded outer section (32) of said insert (30) extends through said inner collar (53) and is threadedly engaged with a nut (40), thereby attaching said head (50) to said shaft (10).

4. The golf club as claimed in claim 3, wherein said primary weight (20) and said insert (30) are joined to said shaft (10) by gel (70).

* * * * *